US009022508B2

(12) United States Patent
Ue et al.

(10) Patent No.: US 9,022,508 B2
(45) Date of Patent: May 5, 2015

(54) PRINTING APPARATUS AND PRINTING METHOD

(75) Inventors: Hiroshi Ue, Matsumoto (JP); Tokujiro Okuno, Matsumoto (JP); Atsushi Sumii, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 249 days.

(21) Appl. No.: 13/478,057

(22) Filed: May 22, 2012

(65) Prior Publication Data

US 2012/0299992 A1 Nov. 29, 2012

(30) Foreign Application Priority Data

May 25, 2011 (JP) ..... 2011-116517

(51) Int. Cl.
*B41J 29/38* (2006.01)
*B41J 3/60* (2006.01)
*B41J 2/01* (2006.01)

(52) U.S. Cl.
CPC ..... *B41J 3/60* (2013.01)

(58) Field of Classification Search
CPC ..... B41J 29/38; B41J 11/42; B41J 29/393; B41J 11/0005; B41J 2/2114; B41J 11/0015; G03G 15/00; G03G 15/6576; G03G 2215/00662; B65H 23/34; B65H 5/36; B65H 29/52; B65H 3/66; B65H 2301/51256; B41M 5/52; B41M 5/5218; B41M 5/5254
USPC ..... 347/16, 101, 105
See application file for complete search history.

(56) References Cited

U.S. PATENT DOCUMENTS

| | | | | |
|---|---|---|---|---|
| 6,652,060 | B2 * | 11/2003 | Uchida | 347/16 |
| 7,360,857 | B2 * | 4/2008 | Koshikawa | 347/16 |
| 8,029,126 | B2 * | 10/2011 | Imoto | 347/104 |
| 8,061,797 | B2 * | 11/2011 | Mizutani | 347/16 |
| 8,205,956 | B2 * | 6/2012 | Kawamata et al. | 347/16 |
| 8,379,232 | B2 * | 2/2013 | Hasegawa et al. | 358/1.1 |
| 8,672,440 | B2 * | 3/2014 | Itogawa | 347/16 |
| 2002/0192000 | A1 | 12/2002 | Yasui et al. | |
| 2012/0299990 | A1 * | 11/2012 | Kohnotoh et al. | 347/14 |

FOREIGN PATENT DOCUMENTS

JP 2000-001010 A 1/2000

* cited by examiner

*Primary Examiner* — Jannelle M. Lebron
*Assistant Examiner* — Jeremy Bishop
(74) *Attorney, Agent, or Firm* — Kilpatrick Townsend & Stockton LLP

(57) ABSTRACT

In a transport for reversing a front and a back of a paper so as to print the back of a printing paper after printing the front of the printing paper, an attachment amount of ink to the front of the printing paper is determined for each region of the front, and on the path of the transport, in a predetermined position where the warpage of the opposite direction to the warpage of the swelling curl of the printing medium generated by the attachment of ink to the front of the printing paper is generated in a site of the printing paper having a region in which the amount of ink attachment is determined to be equal to or greater than a predetermined value, the transport of the printing medium waits for a predetermined time.

6 Claims, 21 Drawing Sheets

| | | |
|---|---|---|
| MIDDLE REGION | HIGH DUTY (Da > X) | WEAKLY CURLS (WAITING POSITION B) |
| | MIDDLE AND LOW DUTY (X > Da) | DOES NOT CURL (DOES NOT WAIT) |
| REAR END POSITION | HIGH DUTY (Db > V) | STRONGLY CURLS (WAITING POSITION A) |
| | MIDDLE DUTY (V > Db > W) | WEAKLY CURLS (WAITING POSITION B) |
| | LOW DUTY (W > Db) | DOES NOT CURL (DOES NOT WAIT) |
| TIP REGION | HIGH DUTY (Dc > Y) | STRONGLY CURLS (WAITING POSITION A) |
| | MIDDLE DUTY (Y > Dc > Z) | WEAKLY CURLS (WAITING POSITION B) |
| | LOW DUTY (Z > Dc) | DOES NOT CURL (DOES NOT WAIT) |

FIG. 8A
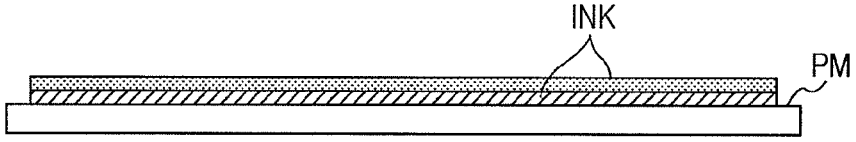
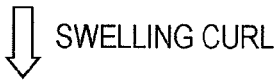
FIG. 8B
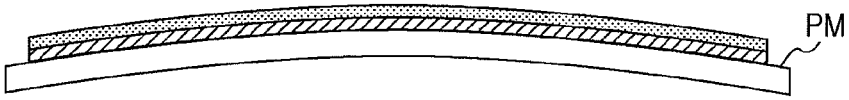
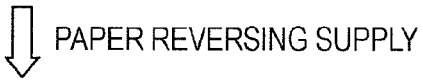
FIG. 8C
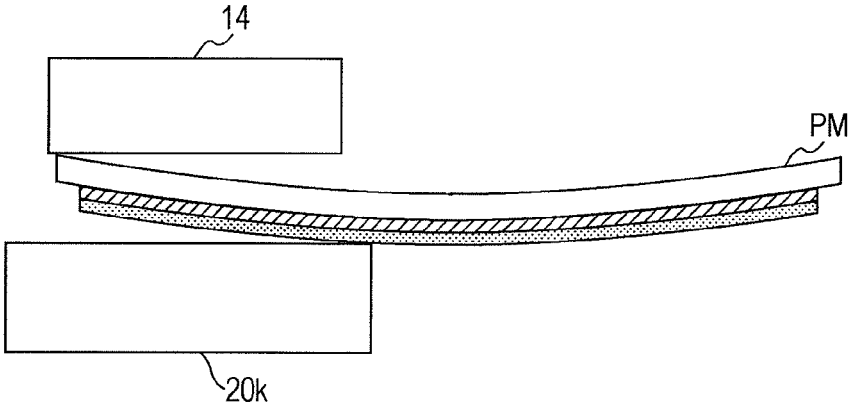

FIG. 11

| | | |
|---|---|---|
| MIDDLE REGION | HIGH DUTY (Da > X) | WEAKLY CURLS (WAITING POSITION B) |
| | MIDDLE AND LOW DUTY (X > Da) | DOES NOT CURL (DOES NOT WAIT) |
| REAR END POSITION | HIGH DUTY (Db > V) | STRONGLY CURLS (WAITING POSITION A) |
| | MIDDLE DUTY (V > Db > W) | WEAKLY CURLS (WAITING POSITION B) |
| | LOW DUTY (W > Db) | DOES NOT CURL (DOES NOT WAIT) |
| TIP REGION | HIGH DUTY (Dc > Y) | STRONGLY CURLS (WAITING POSITION A) |
| | MIDDLE DUTY (Y > Dc > Z) | WEAKLY CURLS (WAITING POSITION B) |
| | LOW DUTY (Z > Dc) | DOES NOT CURL (DOES NOT WAIT) |

Ra > Rb

Pa > Pb

PRINTING APPARATUS AND PRINTING METHOD

This application claims priority to Japanese Patent Application No. 2011-116517, filed May 25, 2011, the entirety of which is incorporated by reference herein.

BACKGROUND

1. Technical Field

The present invention relates to a printing apparatus and a printing method. Particularly, the invention relates to a printing apparatus and a printing method which perform a transportation of a printing medium for performing an attachment of liquid to the other surface of the printing medium after performing the attachment of liquid to one surface of the printing medium.

2. Related Art

In recent years, many printing apparatuses such as printers have been equipped with a double-sided printing mechanism, and the most-widely used double-sided type printer is a type on which a recording head and a paper reversing mechanism are mounted. In such a printer, after printing one surface of the printing paper by a recording head, a front and a back of the printing paper are reversed by passing through a predetermined transport path, thereby also performing the printing of the other surface by the same recording head.

Herein, when ink is attached to the printing paper and the printing paper absorbs ink, since the surface of the printing paper swells but a site other than the printing paper surface does not swell significantly, it is known that a phenomenon (hereinafter, also referred to as a "swelling curl") is generated which causes a warpage such as an expansion of the surface the printing paper. The paper, in which the swelling curl is generated, may come into contact with a member in the printer when being transported in the printer and there is a concern that the printing quality may be adversely affected (an abrasion, dirt, a paper folding or the like).

In order to avoid the adverse affect on the print quality, in the related art, largely two types of measure have been taken. A first measure is to alleviate the swelling curl of the printing paper by performing a forced drying or the like using a drying delay and a warm air heater before the printing of the back when the printing to the front is finished (for example, see JP-A-2000-1010). A second measure is to provide a mechanism which gives a warpage of an opposite direction to the warpage of the swelling curl to the printing paper to forcibly remove the warpage of the swelling curl (hereinafter, referred to as a "decurl").

However, the swelling curl is generated in a site in which the printing is performed, but the technique mentioned above does not consider which site of the printing paper is printed. Furthermore, a degree of the swelling curl fluctuates depending on an amount of moisture contained in ink and an amount of ink attached to each site of the paper, but, the technique mentioned above does not consider the amount of ink attached to each site of the printing paper.

Furthermore, even when the drying waiting is performed, it is difficult to reliably decurl the swelling curl, and thus the drying and waiting are insufficient as measures for the swelling curl. Furthermore, even when the drying is performed by the warm air heater, it is difficult to reliably decurl the swelling curl, and thus the warm air heater is insufficient as a measure for the swelling curl. Furthermore, when separately providing a mechanism for decurl, the cost is increased and a design is changed, and there is a need for an extra space that accommodates the mechanism.

SUMMARY

An advantage of some aspects of the invention is to provide a printing apparatus and a printing method that are able to perform at least a suitable decurl depending on an amount of attached ink, without increasing the cost by adding a special mechanism for decurl or the like.

According to an aspect of the invention, there is provided a printing apparatus which performs the transport of a printing medium for performing an attachment of liquid to the other surface of the printing medium after performing the attachment of liquid to one surface of the printing medium, the printing apparatus including a unit which determines an attachment amount of liquid for each region of the one surface; and a transport waiting unit which causes a predetermined site of the printing medium to wait in a waiting position on a path of the transport for a predetermined time. Herein, the predetermined site is a site that has a region in which the attachment amount of liquid is determined to be equal to or greater than a predetermined value by the determination unit, and the waiting position is a position where the warpage of the opposite direction to the warpage of the printing medium generated by the attachment of liquid to the one surface is generated in the printing medium.

In the configuration mentioned above, if the printing medium is a planer medium and liquid can be attached thereto, any medium can be used, that is, media, a transparent film or the like used in a thick banner such as a vinyl chloride as well as a paper-based printing medium (a glossy paper, a matte paper, a plain paper or the like) may be adopted. In addition, one of the front and the back of the printing medium constitutes the one surface, and the other of them constitutes the other surface.

Furthermore, the transport may be a transport which reverses the front and the back of the printing medium so that a liquid discharging portion (for example, a print head or the like) attaching liquid to the one surface can attach liquid to the other surface, and may be a transport which moves the printing medium to a position where another liquid discharging portion different from the liquid discharging portion discharging liquid to the one surface can attach liquid to the other surface. Furthermore, the predetermined time may be a time of an extent that the warpage generated in the printing medium is solved, and for example, it is possible to use a time required for fixing the liquid to the printing medium or a time in which a time required for the transport is subtracted from the time. In addition, the predetermined time may be determined by considering the amount of liquid attached to the one surface, a liquid type, a type of the printing medium or the like, and a printing environment such as a temperature and humidity. Generally, the warpage generated in the printing medium is a warpage in which the one surface attached with the liquid swells, but, of course, a possibility is not excluded in which the reverse warpage is generated depending on a material of the printing medium and a material of a liquid.

According to the configuration, a site that has a region, in which the attachment amount of liquid is determined to be equal to or greater than a predetermined value, is decided to the predetermined part, based on the attachment amount of liquid determined for each region of the one surface, and the transport waiting unit causes the transport to wait for a predetermined time in a state where the predetermined site is in the waiting position. When the waiting is performed, the predetermined site having the warpage by attaching the liquid enters a state of being deflected in the opposite direction to the warpage, and thus, until the waiting is finished and the transport is started, the warpage generated by the attachment of liquid is solved. In this manner, since the warpage is solved by performing the waiting in the suitable position on the transport path, there is no need to add a new mechanism or the like for solving the warpage. Furthermore, since the waiting is performed with respect to a site in which the attachment amount of liquid exceeds a predetermined value, the warpage is solved with respect to the required location in a required case.

In the aspect of the invention, the waiting position may be a position where an end of the predetermined site in a direction, along which the printing medium is transported, is pinched by a pressing member, whereby the other end of the predetermined site in the direction, along which the printing medium is transported, is pressed against a predetermined table surface. In this manner, by pinching the predetermined site so that the other end thereof is pressed against the predetermined table surface when pinching the one end thereof by the biasing member, a site from the one end of the predetermined site to the other end thereof is reliably bent in an opposite direction to the pressed direction (the warpage is generated). Since the waiting position is the warpage of the opposite direction to the warpage of the printing medium generated in the attachment of liquid to the one surface, the bending waits in the waiting position, whereby it is possible to solve the warpage of the printing medium generated by the attachment of liquid to the one surface.

In the aspect of the invention, the waiting position may be a position where the entire predetermined site comes into contact with a reverse roller which reverses the front and the back of the printing medium. According to the configuration, the warpage depending on a curvature of the reverse roller is generated in the predetermined site, and waits in the waiting position, whereby it is possible to solve the warpage of the printing medium generated by the attachment of liquid to the one surface.

In the aspect of the invention, the predetermined site may be a site which has a region in which the attachment of liquid to the one surface is performed in a state of pinching at least one end of the predetermined site by the biasing member, and the waiting position may be a position where the entire predetermined site comes into contact with the reverse roller reversing the front and the back of the printing medium. According to the configuration, the site, in which the attachment of liquid is performed in the state where both ends are fixed, also waits in the waiting position, whereby it is possible to suitably solve the warpage of the printing medium generated by the attachment of liquid to the one surface.

In the aspect of the invention, in the waiting position, the biasing member, which maintains a state of generating a warpage of an opposite direction to the warpage of the printing medium generated by the attachment of liquid to the one surface in the printing medium, may be configured to pinch the printing medium, and when there is a plurality of waiting positions, some waiting positions are selected depending on curvatures of the warpage which is an opposite direction to the warpage of the printing medium generated by the attachment of liquid to the one surface and is generated in each waiting position, a range of the printing medium in a width direction in which the biasing member pinches the printing medium in each waiting position, and a biasing force by which the biasing member pinches the printing medium in each waiting position. According to the configuration, depending on the warpage (the warpage of the printing medium generated by the attachment of liquid to the one surface) generated in the printing medium, a reference for selecting the waiting position optimal for solving the warpage from the plurality of waiting positions may be selected.

In addition, the printing apparatus mentioned above includes various aspects such as methods being carried out by being incorporated into another equipment or carried out together with another method. Furthermore, the invention is also able to be realized as a printing system including the printing apparatus, a printing method having a process corresponding to the configuration of the printing apparatus, a program which causes a computer to realize a function corresponding to the configuration of the printing apparatus, a recording medium on which the program is recorded and which can be read by a computer or the like.

BRIEF DESCRIPTION OF THE DRAWINGS

The invention will be described with reference to the accompanying drawings, wherein like numbers reference like elements.

FIGS. 8A to 8C are explanatory diagrams of a swelling curl that is generated in the printing paper.

FIG. 11 is a diagram that describes a corresponding relationship between an amount of ink injection and a waiting position in each region.

DESCRIPTION OF EXEMPLARY EMBODIMENTS

Hereinafter, an embodiment of the invention will be described according to an order as below.

1. Configuration of Printing Apparatus:
2. Transport Control Processing:
3. Modified Examples:

1. CONFIGURATION OF PRINTING APPARATUS

Overall Configuration of Printer

Figure 1:
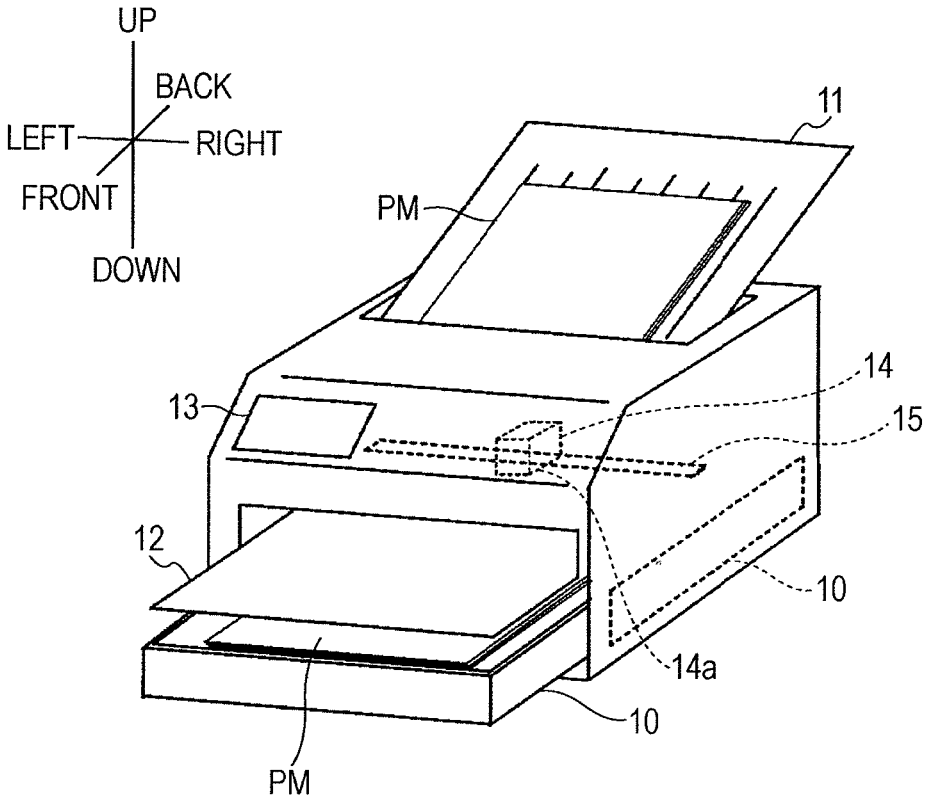
FIG. 1 is an exterior diagram of a printer.

FIG. 1 shows an example of an exterior of a printer. In addition, a movement direction, an attachment position or the like of a member will be described with reference to up, down, left, right, front and back shown in FIG. 1, but the movement direction, the attachment position or the like of the member is of course suitably changed depending on a design. In FIG. 1, a printer 100 includes a paper feeding cassette 10, an input tray 11, a stacker 12, and an operation panel 13 in appearance.

The paper feeding cassette 10 is provided in a front lower portion of the printer 100 so as to be able to be drawn to the front, and a plurality of sheets of printing paper PM can be accommodated in an inner portion thereof. When accommodating the paper feeding cassette 10 in the inner portion of the printer 100, the printing paper PM accommodated in the paper feeding cassette 10 can be printed. That is, when the printing to the printing paper PM accommodated in the paper feeding cassette 10 is instructed by a host device (not shown) connected to the operation panel 13 or the printer 100, an automatic paper separation portion ADF1 described later separates a sheet of printing paper PM from the paper feeding cassette 10, and is able to send the paper to the paper feeding path. The host device is constituted by, for example, a computer in which a driver of the printer 100 is installed.

In the middle of the paper transport path, a carriage 14 is provided which can reciprocate in a main scanning direction (a left and right direction in FIG. 1) along a guide shaft 15 extending from left to right. By discharging and attaching ink to the printing paper PM to be transported in a sub scanning direction (a front and back direction in FIG. 1) perpendicular to the main scanning direction at a suitable timing, while reciprocating in the main scanning direction, characters and images are formed (printed) on a surface of the printing paper PM. The printing paper PM, in which the formation of the characters and the images are completed, is discharged to the outside of the printer 100 and is stacked on a stacker 12.

In a lower portion of the carriage 14, a recording head 14*a* is provided which ejects (discharges) the ink, and in the lower portion of the recording head 14*a* in a main body case, a platen 20*k* (see FIG. 2 or the like) is placed. The platen 20*k* causes a table surface long in the left and right direction to face the recording head 14*a*, and in each position of the main scanning, the recording head 14*a* and the table surface are formed so as to be equidistant. Thus, when the printing paper PM is mounted on the platen 20*k*, the distance between the recording head 14*a* and an ink attachment target site is regularly defined. Each ink cartridge of black and color is mounted on the upper portion of the carriage 14, in an attachable and detachable manner. The recording head 14*a* ejects each color ink to be supplied from each ink cartridge, from each color nozzle.

The input tray 11 is provided as a retroverse slope surface in an upper surface rear portion of the printer 100, and a plurality of sheets of printing paper PM can be loaded on the slope surface. When the printing to the printing paper PM loaded on the input tray 11 is instructed by a host device (not shown) connected to the connection panel 13 and the printer 100, an automatic paper separation portion ADF2 described later separates a sheet of printing paper PM from the input tray 11, and sends the printing paper to the paper transport path. The printing paper is printed in the middle of the paper transport path like the printing paper PM supplied from the paper feeding cassette 10, and when the printing is completed, the printing paper is stacked on the stacker 12.

Configuration of Paper Transport Mechanism

Next, a paper transport mechanism will be described.

Figure 2:
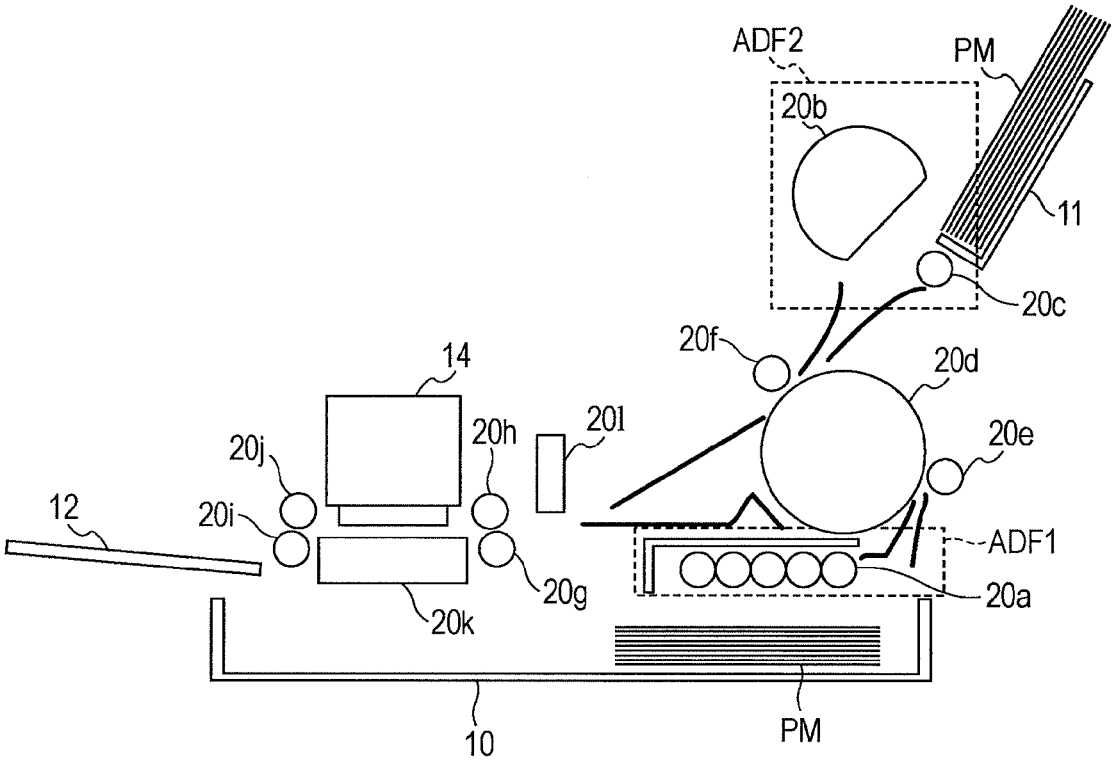
FIG. 2 is a cross-sectional view that shows a member arrangement in a paper transport mechanism.

FIG. 2 is a cross-sectional view that shows a member arrangement in the paper transport mechanism. FIG. 1 is a side view of main portions which shows main portions of the paper transport mechanism of the printer 100 from a side (a right side in FIG. 1), and schematically shows a positional relationship of main configurations of the paper transport mechanism. As shown in FIG. 2, the printer 100 includes a separation roller 20*a*, a separation roller 20*b*, a separation driven roller 20*c*, a middle roller 20*d*, middle driven rollers 20*e* and 20*f*, a paper feeding roller 20*g*, a paper feeding driven roller 20*h*, a paper discharging roller 20*i*, a paper discharging driven roller 20*j*, a platen 20*k*, and a paper detection sensor 20*l*. In addition, members, which guide the paper so as to be transported in a predetermined transport path, are placed in each location, and are shown in bold in FIG. 2.

Paper Feeding from Cassette

Figure 3:
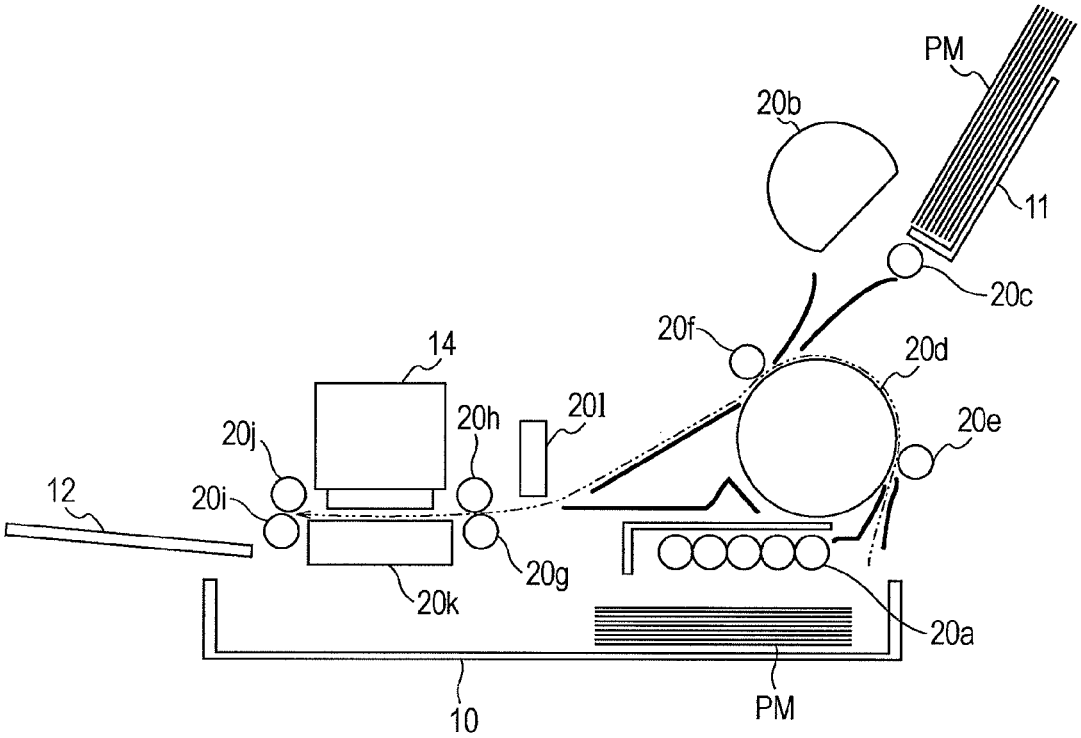
FIG. 3 is a diagram that shows a transport path of a printing paper fed from a paper feeding cassette.
Figure 4A:
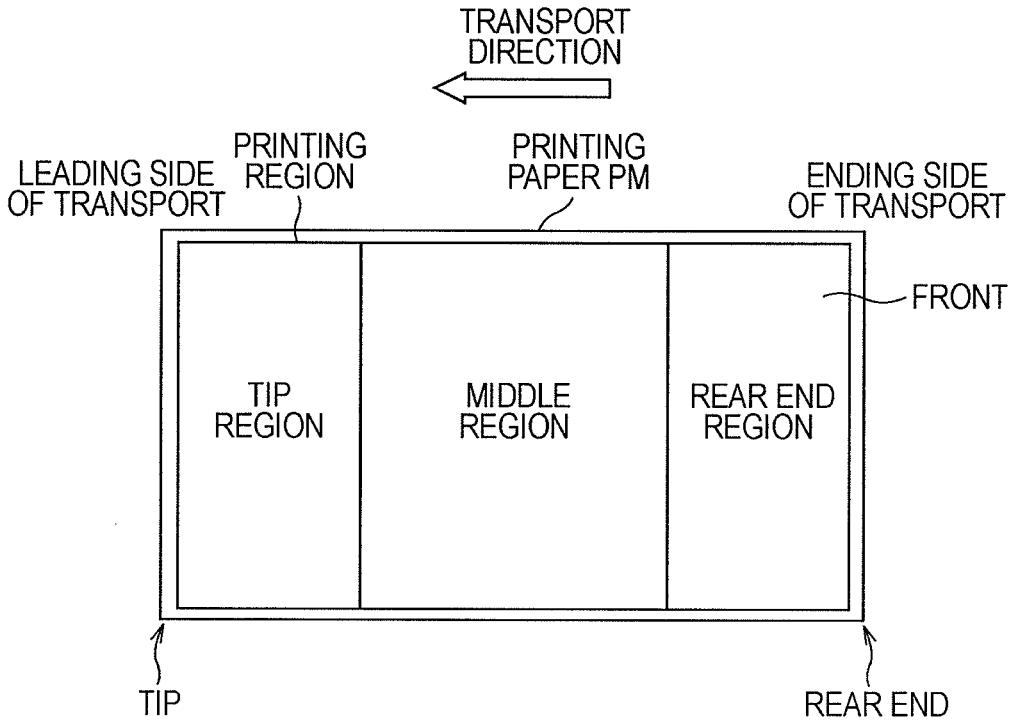
FIGS. 4A and 4B are diagrams that describe a region in a determination of an amount of ink injection for the printing paper.
Figure 4B:
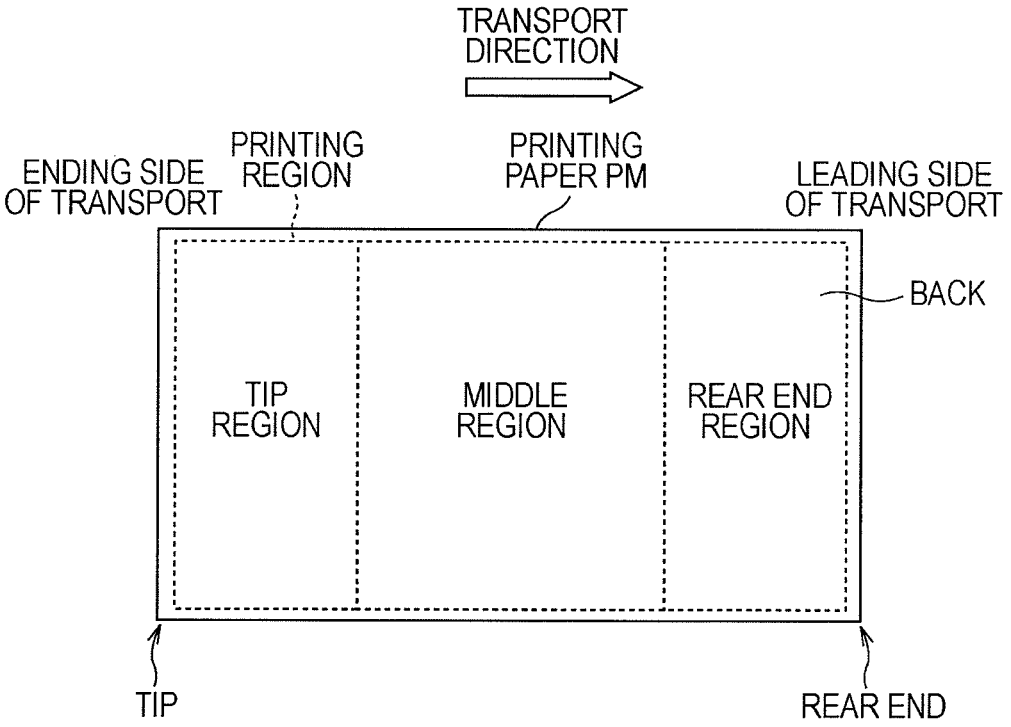

FIG. 3 is a diagram that shows the transport path of the printing paper PM to be fed from the paper feeding cassette 10, and FIGS. 4A and 4B are diagrams that describe a region in the determination of an amount of ink injection for the printing paper PM described later. In FIG. 3, the transport path of the printing paper PM to be fed from the paper feeding cassette 10 is shown by a two-dot dash line. In addition, hereinafter, the amount of ink injection is also described as an ink duty.

When the paper feeding from the paper feeding cassette 10 is selected, the printing paper PM comes into contact with the separation roller 20*a* by a predetermined mechanism, and a sheet of the printing paper PM accommodated in the paper feeding cassette 10 reaches between the middle roller 20*d* and the middle driven roller 20*e* by the rotation driving (the driving in a counterclockwise rotation direction in FIG. 3) of the separation roller 20*a*. In addition, a mechanism (not shown) or the like for bringing the separation roller 20*a* and the printing paper PM into contact with the separation roller 20*a* constitutes the automatic paper separation portion ADF1.

The printing paper PM fed by the automatic paper separation portion ADF1 is transported to the middle roller 20*d* and the middle driven roller 20*e* while being pressed and pinched, mainly by a forward direction rotation driving (the rotation riving of a counterclockwise rotation direction in FIG. 3) of the middle roller 20*d*, and the tip thereof reaches between the middle roller 20*d* and the middle driven roller 20*f* (state 1-1).

In addition, by the forward direction rotation driving of the middle roller 20*d*, until the middle, the printing paper PM is transported between the middle roller 20*d* and the middle driven roller 20*e* and between the middle roller 20*d* and the middle driven roller 20*f* while being pressed and pinched, and from the middle, the printing paper PM is transported between the middle roller 20*d* and the middle driven roller 20*f* while being pressed and pinched, and the tip thereof reaches between the paper feeding roller 20*g* and the paper feeding driven roller 20*h* (state 1-2).

After that, mainly by the forward direction rotation direction of the middle roller 20*d* and the paper feeding roller 20*g*, until the middle, the printing paper PM is transported between the middle roller 20*d* and the middle driven roller 20*e* and between the paper feeding roller 20*g* and the paper feeding driven roller 20*h* while being pressed and pinched, and from the middle, the printing paper PM is transported between the paper feeding roller 20*g* and the paper feeding driven roller 20*h* while being pressed and pinched, and the tip thereof reaches between the paper discharging roller 20*i* and the paper discharging roller 20*j* (state 1-3). The printing to the surface of the printing paper PM is started between the state 1-2 and the state 1-3.

A region on the printing paper PM becoming the printing target from the state 1-2 to the state 1-3 constitutes a tip region shown in FIG. 4. Herein, from the state 1-2 to the state 1-3, the rear end side of the paper is pinched between the paper feeding roller 20*g* and the paper feeding driven roller 20*h*, but the tip side of the paper is printed without being held. Thus, a swelling curl described later is easily generated in the tip region, but since the front printing is performed firstly in the printing paper PM and the back printing is performed finally, the relatively long drying time of ink is secured. Furthermore, since the paper is located at the end in the transport of the back printing, even when the curl is generated, the defect such as a paper folding is not significantly generated.

After that, mainly by the forward direction rotation driving of the paper feeding roller 20*g* and the paper discharging roller 20*i*, the printing paper PM is transported between the paper feeding roller 20*g* and the paper feeding driven roller 20*h* and between the paper discharging roller 20*i* and the paper discharging driven roller 20*j* while being pressed and pinched, and the rear end of the printing paper PM reaches between the paper feeding roller 20*g* and the paper feeding driven roller 20*h* (state 1-4). The printing to the surface of the printing paper PM also continues between the state 1-3 and the state 1-4.

A region of the printing paper PM becoming the printing target from the state 1-3 to the state 1-4 constitutes a middle region shown in FIGS. 4A and 4B. Herein, between the state 1-2 and the state 1-3, the printing is performed in the state where the tip side of the paper is pinched between the paper discharging roller 20*i* and the paper discharging driven roller 20*j* and the rear end side thereof is pinched between the paper feeding roller 20*g* and the paper feeding driven roller 20*h*, and thus the swelling curl described later is not significantly generated. Furthermore, since the middle region is located in the middle of the paper, originally, the curl is hardly generated.

After that, mainly by the forward direction rotation direction of the paper discharging roller 20*i*, while the printing paper PM is pressed and pinched between the paper discharging roller 20*i* and the paper discharging driven roller 20*j*, the printing paper is transported until at least the rear end (or the rear end of the printing region of the surface of the printing paper PM) of the printing paper PM completely passes through the recording range of the recording head and leaves (state 1-5). The printing to the surface of the printing paper PM also continues between the state 1-4 and the state 1-5.

A region of the printing paper PM becoming the printing target from the state 1-4 to the state 1-5 constitutes a rear end region shown in FIG. 4. Herein, between the state 1-4 and the state 1-5, the tip side of the paper is pinched between the paper discharging roller 20*i* and the paper discharging driven roller 20*j*, but the rear end side of the paper is printed without being held. Thus, the swelling curl described later is easily generated in the rear end region, the front printing is performed finally and the back printing is performed firstly. Accordingly, the drying time of ink is short, and the paper is located at the tip side of the transport after reversing the front and the back of the paper, and thus the defect such a paper folding is easily generated.

After that, in the case of the front printing, mainly by the forward direction rotation driving of the paper discharging roller 20*i*, the paper is transported while being pressed and pinched between the paper discharging roller 20*i* and the paper discharging driven roller 20*j*. When the paper exits between the paper discharging roller 20*i* and the paper discharging driven roller 20*j*, the paper is stacked on the stacker 12. Meanwhile, in the case of the double-sided printing, by an opposite direction rotation driving (the rotation driving of the clockwise rotation direction in FIG. 3) of the paper discharging roller 20*i*, a reverse paper feeding shown in FIG. 5 described later is performed.

Paper Feeding from Input Tray

Figure 5:
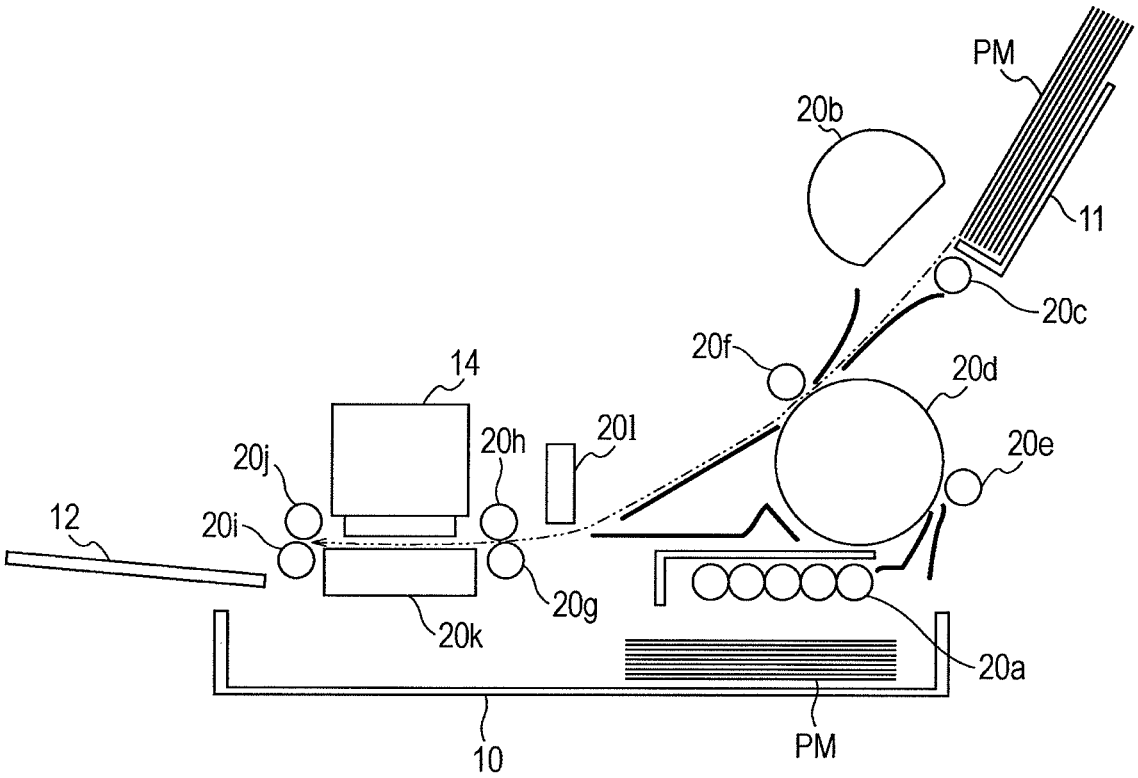
FIG. 5 is a diagram that shows the transport path of the printing paper which is fed by an automatic paper separation portion.

FIG. 5 is a diagram that shows the transport of the printing paper PM which is fed by the automatic paper separation portion ADF2. In FIG. 5, the transport path of the printing paper PM to be fed from automatic paper separation portion ADF2 is shown by a two-dot dash line.

When the paper feeding from the input tray 11 is selected, the printing paper PM comes into contact with the separation roller 20*b* by a predetermined mechanism, and a sheet of the printing paper PM loaded on the input tray 11 reaches between the middle roller 20*d* and the middle driven roller 20*f* by the rotation driving (the driving in a clockwise rotation direction in FIG. 5) of the separation roller 20*b*. In addition, a mechanism (not shown) or the like for bringing the separation roller 20*b* and the printing paper PM into contact with the separation roller 20*b* constitutes the automatic paper separation portion ADF2.

In addition, mainly by the forward direction rotation driving of the middle roller 20*d*, the printing paper PM is transported while being pressed and pinched between the middle roller 20*d* and the middle driven roller 20*f*, and the tip thereof reaches between the paper feeding roller 20*g* and the paper feeding driven roller 20*h*. In addition, the state is the same as the state 1-2 of the printing paper PM fed from the paper feeding cassette 10 mentioned above, and after the state 1-2, the same transport as that of the printing paper PM fed from the paper feeding cassette 10 mentioned above is performed.

Reverse Paper Feeding

Next, the paper reversal and the printing to the reversed paper of the case of performing the two-sided printing will be described.

Figure 6:
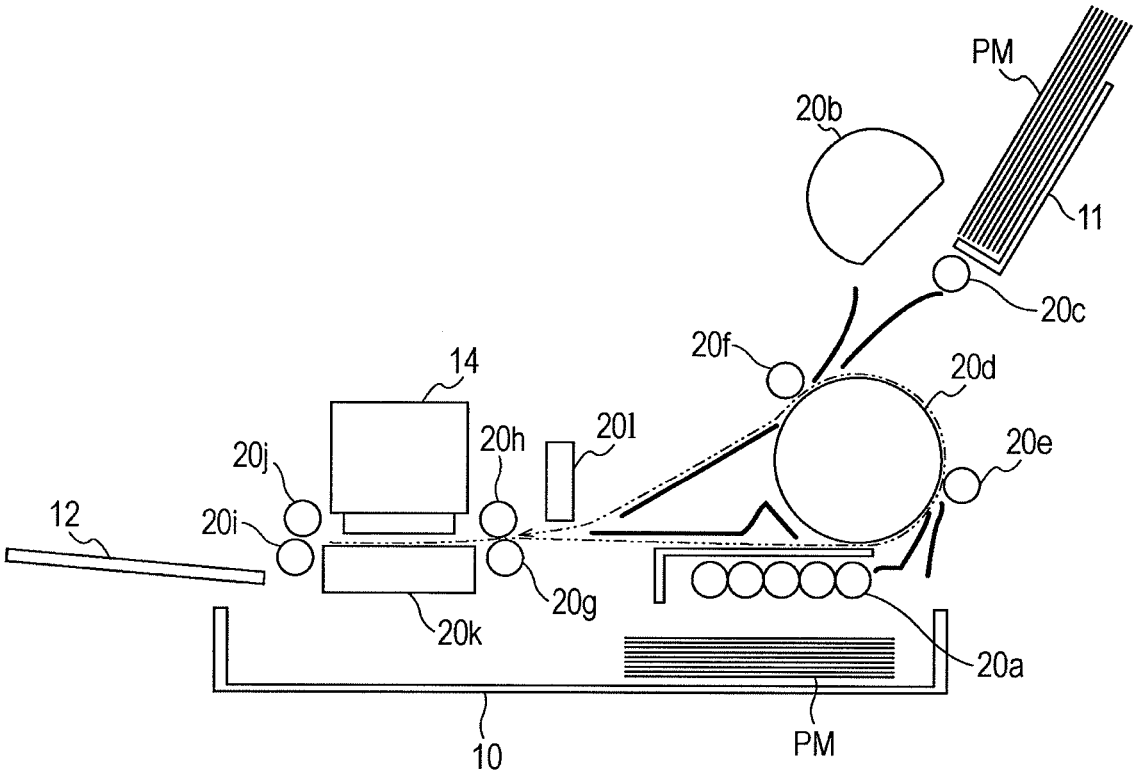
FIG. 6 is a diagram that shows a reverse paper feeding path.

FIG. 6 is a diagram that shows the reverse paper feeding path. In FIG. 6, the reverse paper feeding path is shown by a two-dot dash line. When the reverse paper feeding is started, by the opposite direction rotation driving (the rotation driving of the clockwise direction in FIG. 6) of the paper discharging roller 20*i*, the printing paper PM is transported while being pressed and pinched between the paper discharging roller 20*i* and the paper discharging driven roller 20*j*, the rear end thereof reaches between the paper feeding roller 20*g* and the paper feeding driven roller 20*h*, and the rear end enters the state of being pinched between the paper feeding roller 20*g* and the paper feeding driven roller 20*h*.

Figure 7:
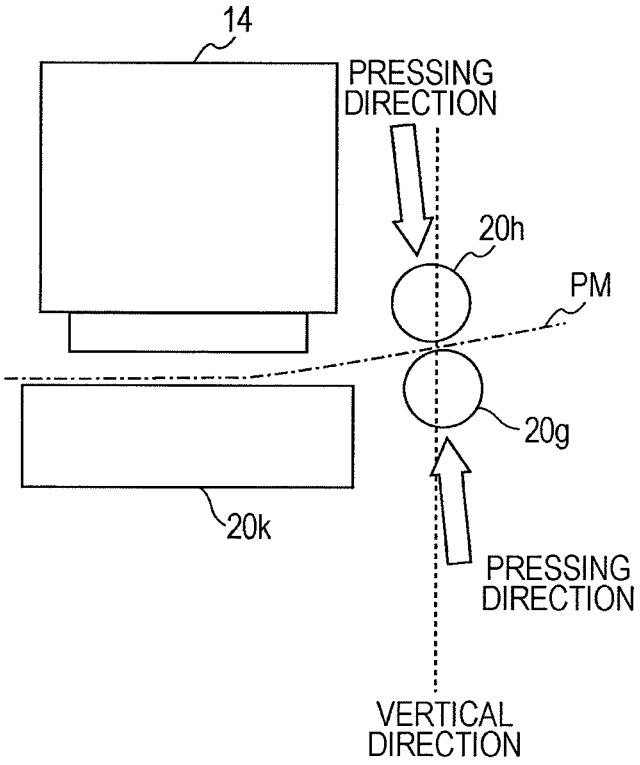
FIG. 7 is a diagram that describes a pressing direction of a paper feeding roller and a paper feeding driven roller.

FIG. 7 is a diagram that describes a pressing direction of the paper feeding roller 20*g* and the paper feeding driven roller 20*h*. In addition, in FIG. 7, the printing paper PM is shown by a dot dash line, and in the drawings after FIG. 7, the case of showing the printing paper PM in the drawings will also be shown by a dot dash line. As shown in FIG. 7, the pressing direction of the paper feeding roller 20*g* and the paper feeding driven roller 20*h* to the printing paper PM is tilted in the counterclockwise direction from the up and down vertical direction of the drawings, and the paper, which is at the platen side behind the site pinched between the paper feeding roller 20*g* and the paper feeding driven roller 20*h*, enters a state of being pressed against the surface of the platen. At this time, the printing paper PM is warped downward in the drawing, a decurl effect mentioned below occurs in the site overlapping with the location where the warpage occurs, and the state of locating the location becoming the decurl target in the location where the warpage occurs, is called a waiting position A.

Next, mainly by the opposite direction rotation driving of the paper discharging roller 20*i*, the paper feeding roller 20*g* and the middle roller 20*d*, the printing paper PM is transported while being pressed and pinched between the paper discharging roller 20*i* and the paper feeding driven roller 20*h* and between the paper feeding roller 20*g* and the paper feeding driven roller 20*h*. From the middle, the paper is transported while being pressed and pinched between the paper feeding roller 20*g* and the paper feeding driven roller 20*h*, and the rear end thereof reaches between the middle roller 20*d* and the middle driven roller 20*e* and is transported while being pressed and pinched between the middle roller 20*d* and the middle driven roller 20*e*, and the rear end reaches between the middle roller 20*d* and the middle driven roller 20*f*. While being transported in this way, a state is generated where the printing paper PM is wound around the middle roller 20*d*, but at this time, a state, where a particular region of the printing paper PM is pressed against the curved surface of the middle roller 20*d* by at least one of the middle driven roller 20*e* and the middle driven roller 20*f*, is called a waiting position B. In addition, the particular region refers to one of the middle region, the rear end region, and the tip region mentioned above.

After that, mainly by the opposite direction rotation driving of the middle roller 20*d*, the printing paper PM is transported while being pressed and pinched between the middle roller 20*d* and the middle driven roller 20*e* and between the middle roller 20*d* and the middle driven roller 20*f*, and the rear end thereof reaches between the paper feeding roller 20*g* and the paper feeding driven roller 20*h*. In this manner, the front and the back of the printing paper PM transported up to between the paper feeding roller 20*g* and the paper feeding driven roller 20*h* is reversed from the first printing and the back faces upward. Thus, by suitably discharging ink from the recording head while suitably moving the carriage while performing the sub scanning which gradually sends the printing paper PM to the left side by the paper feeding roller 20*g* and the paper feeding driven roller 20*h*, the back of the printing paper PM is printed.

In this manner, the middle roller 20*d* used when reversing the front and the back of the printing paper PM constitutes the reverse roller in the present embodiment. In addition, it is needless to say that the rollers used in each state mentioned above and when transporting the printing paper PM to each waiting position differ depending on the length of the printing paper PM.

Reason for Swelling Curl Generation and Need for Waiting

FIGS. 8A to 8C are explanatory diagrams of the swelling curl that is generated in the printing paper PM. As shown in FIG. 8A, ink is attached to the surface of the printing paper PM to be sent to the reverse paper feeding path by the printing to the surface performed just before, and as shown in FIG. 8B, the surface swells and the swelling curl is generated. For that reason, as shown in FIG. 8C, when printing the back after reversing the paper, the paper may float above the platen 20*k*, which affects the back printing quality. Specifically, for example, there is a possibility that the paper may become dirty by being rubbed against the recording head, the paper may be folded by the contact, and the printing irregularity due to the distance fluctuation between the recording head and the printing paper PM or the like may be generated. Of course, when the swelling curl is generated at the rear end side of the printing paper PM transported at the beginning during reverse paper feeding, the paper may interfere with members other than the recording head in the transport path, and similarly there is a possibility that the rubbing, the dirtying, the paper folding or the like may be generated. In order to prevent a decline in the back printing quality, in the present embodiment, the waiting described later is performed in a predetermined position on the reverse paper feeding path.

Electrical Configuration of Printing Apparatus

Figure 9:
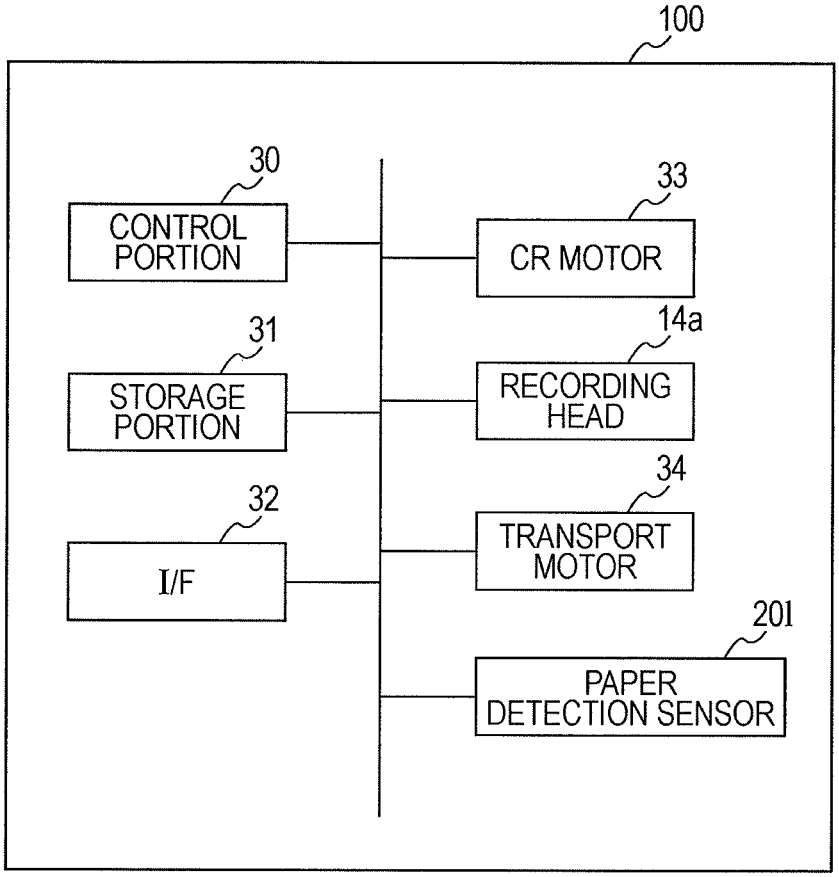
FIG. 9 is a block diagram that shows an electrical and software configuration according to the control of a printer.

FIG. 9 is a block diagram of an electrical and software configuration according to the control of the printer 100. In addition, FIG. 9 shows a configuration relating to the waiting during transport described later, and other configurations according to the printing control can be suitably adopted from the known technologies within the scope not departing from the gist of the invention. In FIG. 9, the printer 100 includes a control portion 30, a storage portion 31, an I/F 32, a carriage motor 33, a recording head 14*a*, a transport motor 34, and a paper detection sensor 20*l* in the entire printer 100. In the storage portion 31, a corresponding relationship with the waiting position decided depending on the magnitude of the amount of ink injection for each region is stored. A host device is connected to the I/F 32, and the printer 100 performs the printing based on the print data that is input from the host device or performs the print setting such as a switch-over between the single-sided printing and the double-sided printing by the instruction from the host device.

The control portion 30 controls the entire printer 100, may be realized in a software manner, for example, by performing the calculation by a CPU while expanding the control program stored in a ROM to a RAM, and may be realized in a hardware manner like an ASIC (Application Specific Integrated Circuit) or the like. For example, the control portion 30 controls the storage portion 31, the I/F 32, the carriage motor 33, the recording head 14*a*, the transport motor 34, and the paper detection sensor 20*l* by executing the control program, and executes the transport control processing as below.

2. TRANSPORT CONTROL PROCESSING

Figure 10:
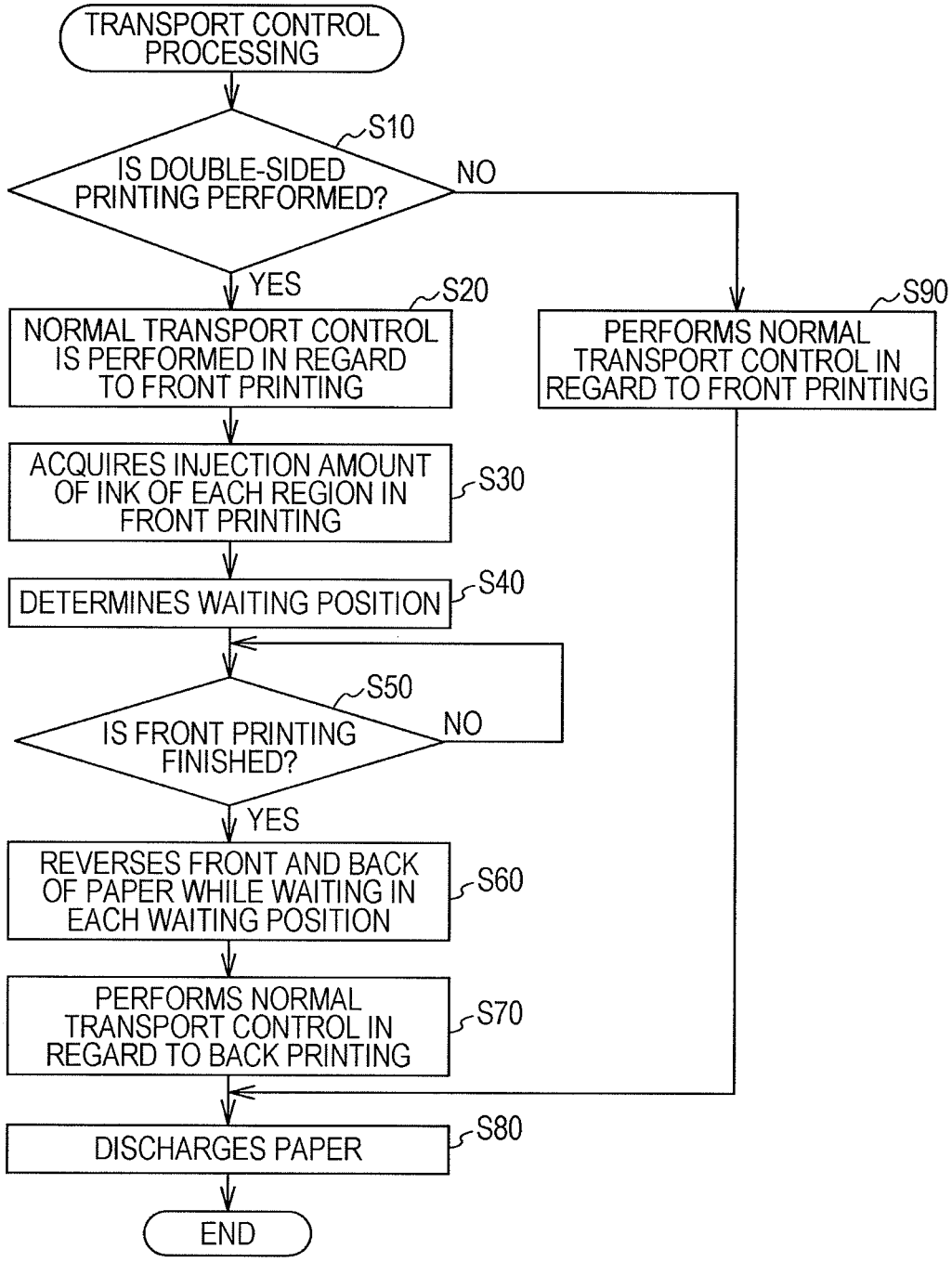
FIG. 10 is a flow chart that shows a flow of a transport control processing.

FIG. 10 is a flow chart that shows the flow of the transport control processing. The processing is executed when the printing is instructed. When the processing is started, it is determined whether or not the double-sided printing is performed (S10). Herein, when the instructed printing is a single-sided printing (S10; No), the normal transport control processing is performed (S90), and when the printing to the surface is completed, the printing paper PM is discharged and stacked on the stacker 12 by the driving of the paper discharging roller 20*i* (S80). Meanwhile, when the instructed printing is the double-sided printing (S10; Yes), firstly, the normal transport control processing is performed in regard to the surface orienting (S20).

In the meantime/either before or after that/or any combined timing thereof, in regard to each of the middle region, the rear end region, and the tip region, an amount of ink injection in the printing of the surface is acquired (S30). The amount of ink injection may be obtained by adding the amount of ink attached to each region to average the amount, but may be obtained as an estimated value, and, for example, an amount of ink coverage calculated according to the known various methods may be used as the amount of ink injection. Furthermore, in addition, the amount of ink injection may be calculated in a host device (not shown) which performs the instruction of the printing to the printer 100 in advance, and may be transmitted from the host device to the printer 100. The control portion 30 executing the step S39 constitutes the determination unit in the present embodiment.

Next, the waiting position is decided based on the amount of ink injection (S40).

FIG. 11 is a diagram that shows the corresponding relationship between the amount of ink injection and the waiting position in each region. The data equivalent to the corresponding relationship shown in FIG. 11 is, for example, stored in the storage portion 31.

In the present embodiment, an amount of ink injection Db per a unit area of the rear end region is classified into three of a high duty, a middle duty, and a low duty. In each case it is decided whether a site of the printing paper PM including the rear end region waits in the waiting position A, waits in the waiting position B, or does not wait, based on the classification result. Herein, in regard to the rear end region, threshold values of the high duty and the middle duty are set to V, and threshold values of the middle duty and the low duty are set to W.

Furthermore, an amount of ink injection Da per a unit area of the middle region is classified into two of the high duty and the middle and low duty. In each case it is decided whether the site of the printing paper PM including the middle region waits in the waiting position B or does not wait based on the classification result. Herein, in regard to the middle region, the threshold values of the high duty and the middle and low duty are set to X. In addition, even if the amount of ink injection Da is large, since the middle region has a small influence due to the swelling curl compared to the rear end region and the tip region, the classification number is reduced compared to the rear end region and the tip region as below, and even for the high duty, the middle region is in the waiting position having the low decurl effect.

Furthermore, an amount of ink injection Dc per a unit area of the tip region is classified into three of a high duty, a middle duty, and a low duty. In each case it is decided whether a site of the printing paper PM including the rear end region waits in the waiting position A, waits in the waiting position B, or does not wait, based on the classification result. Herein, in regard to the tip region, threshold values of the high duty and the middle duty are set to Y, and threshold values of the middle duty and the low duty are set to Z.

Figure 12:
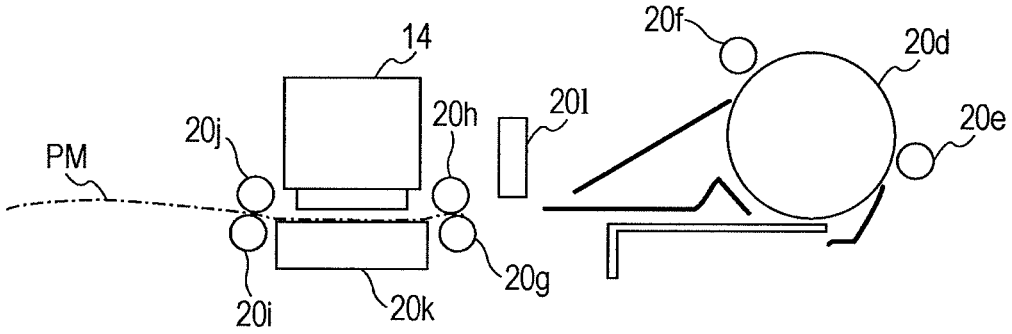
FIG. 12 is a diagram that shows a waiting state of the printing paper when the amount of ink injection of a rear end region is greater than a threshold value V.

FIG. 12 is a diagram that shows the waiting state of the printing paper PM of a case where the amount of ink injection Db of the rear end region is greater than V. As shown in FIG. 12, when the rear end region waits in the waiting position A, the end portion of the ending side of the printing paper PM shown in FIG. 4 waits while being pinched between the paper feeding roller 20*g* and the paper feeding driven roller 20*h*. The reason is that the rear end region is located at the ending side of the transport in the front printing and is located at the beginning side of the transport in the reverse paper feeding after that. Moreover, in the rear end region, the printing paper PM, which is on the platen 20*k* side behind the pinched position between the paper feeding roller 20*g* and the paper feeding driven roller 20*h*, is warped downward. That is, the warpage of the opposite direction to the direction of curling due to the swelling of ink is generated in the rear end region in the front printing.

Figure 13:
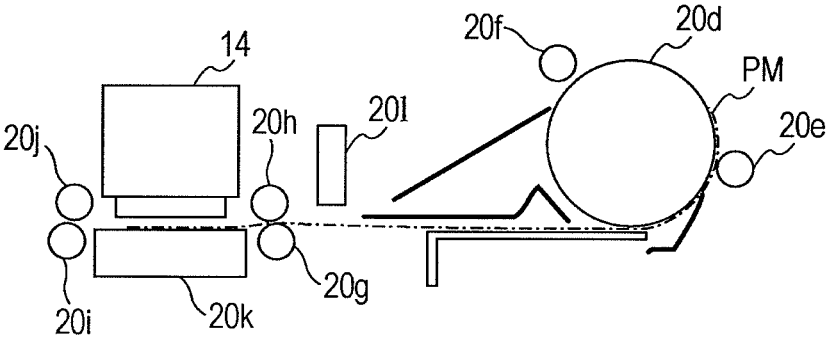
FIG. 13 is a diagram that shows a waiting state of the printing paper when the amount of ink injection of the rear end region is smaller than a threshold value V and greater than a threshold value W.

FIG. 13 is a diagram that shows the waiting state of the printing paper PM of the case where the amount of ink injection Db of the rear end region is lower than V and greater than W. As shown in FIG. 13, when the rear end region waits in the waiting position B, the end portion of the rear end side of the printing paper PM shown in FIG. 4 is pressed and pinched by the middle roller 20*d* and the middle driven roller 20*e*. Moreover, the warpage along the curved surface of the middle roller 20*d* is generated in the rear end region, and the warpage is the warpage of the opposite direction to the direction of curling due to the swelling of ink in the front printing.

Figure 14:
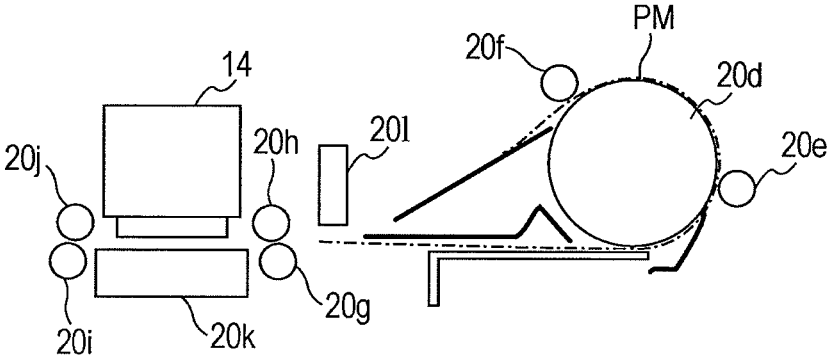
FIG. 14 is a diagram that shows a waiting state of the printing paper when the amount of ink injection of a middle region is greater than a threshold value X.

FIG. 14 is a diagram that shows the waiting state of the printing paper PM of the case where the amount of ink injection Da of the middle region is greater than X. As shown in FIG. 14, when the middle region waits in the waiting position B, the vicinity of the boundary between the rear end region and the middle region shown in FIGS. 4A and 4B is pressed and pinched by the middle roller 20*d* and the middle driven roller 20*f*, and the vicinity of the boundary between the middle region and the tip region is pressed and pinched by the middle roller 20*d* and the middle driven roller 20*e*. Moreover, the warpage along the curved surface of the middle roller 20*d* is generated in the middle region, and the warpage is the warpage of the opposite direction to the direction of curling due to the swelling of ink in the front printing.

Figure 15:
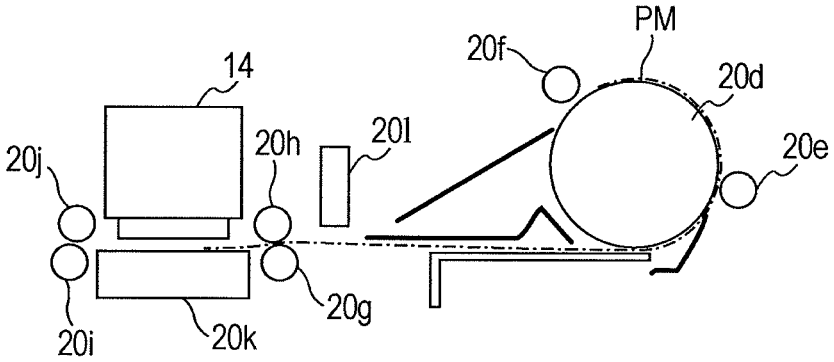
FIG. 15 is a diagram that shows a waiting state of the printing paper when the amount of ink injection of a tip region is greater than a threshold value Y.

FIG. 15 is a diagram that shows the waiting state of the printing paper PM of a case where the amount of ink injection Dc of the tip region is greater than Y. As shown in FIG. 15, when the tip region waits in the waiting position A, the vicinity of the boundary between the middle region and the tip region of the printing paper PM shown in FIGS. 4A and 4B waits in the state of being pinched between the paper feeding roller 20*g* and the paper feeding driven roller 20*h*. The reason is that the middle region is located at the leading side in the front printing and is located at the ending side of the transport in the reverse paper feeding after that. Moreover, in the tip region, the printing paper PM, which is at the platen 20*k* side behind the pinched position between the paper feeding roller 20*g* and the paper feeding driven roller 20*h*, is warped downward. That is, the warpage of the opposite direction to the direction of curling due to the swelling of ink in the front printing is generated in the tip region.

Figure 16:
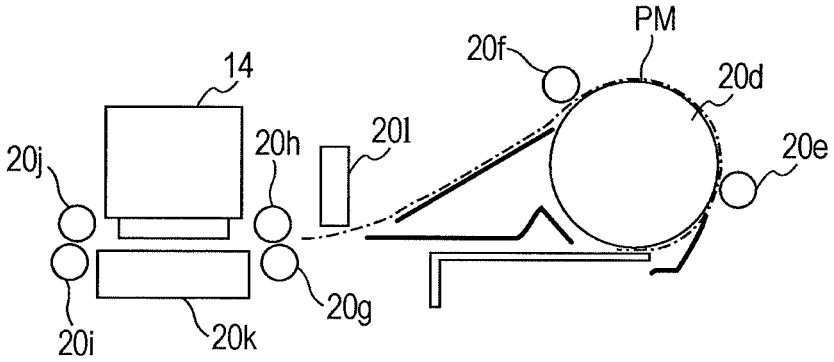
FIG. 16 is a diagram that shows a waiting state of the printing paper when the amount of ink injection of the tip region is smaller than a threshold value Y and greater than a threshold value Z.

FIG. 16 is a diagram that shows the waiting state of the printing paper PM of the case where the amount of ink injection Dc of the tip region is lower than Y and greater than Z. As shown in FIG. 16, when the tip region waits in the waiting position B, the end portion of the tip side of the printing paper PM shown in FIGS. 4A and 4B is pressed and pinched by the middle roller 20*d* and the middle driven roller 20*e*. Moreover, the warpage along the curved surface of the middle roller 20*d* is generated in the tip region, and the warpage is the warpage of the opposite direction to the direction of curling due to the swelling of ink in the front printing.

That is, even in the same part, as the amount of ink injection is large, the waiting is performed in the position having the high decurl effect, and, even if the amount of ink injection is the same, the region formed so as to include the end portion in the transport direction of the paper is adapted to wait in a position having the decurl effect higher than that of the region formed so as not to include the end portion of the paper.

Herein, the decurl effect is an effect that solves the warpage generated in the paper, and basically refers to an effect that solves (decurls) the warpage (the curl) generated in the paper by generating the opposite warpage to the warpage generated in the paper. That is, in the waiting positions A and B, the warpage is of the opposite direction to the warpage generated in the paper. However, a degree of the decurl effect also depends on other factors, and changes, for example, depending on the curvature of the warpage generated in the opposite direction to the warpage generated in the paper, the pressure by which the support member maintaining the warpage suppresses the paper, and a range in which the support member presses the paper in the width direction (a direction perpendicular to the transport direction of the paper).

Figure 17A:
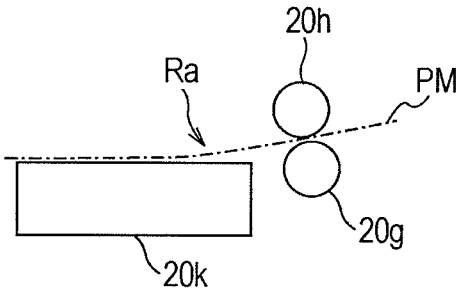
FIGS. 17A and 17B are diagrams that describe a relationship between a decurl effect and a curvature of the warpage generated in an opposite direction to the warpage generated in the paper.
Figure 17B:
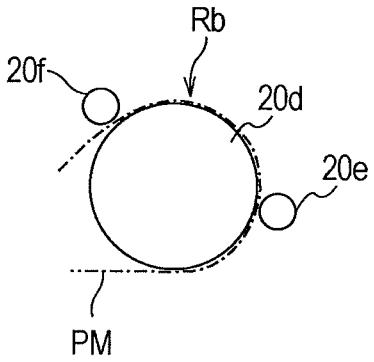

FIGS. 17A and 17B are diagrams that describe the relationship between the decurl effect and the curvature of the warpage generated in the opposite direction to the warpage generated in the paper. A curvature Ra of the warpage generated in the printing paper PM in the waiting position A shown in FIG. 17A is greater than a curvature Rb of the warpage generated in the printing paper PM in the waiting position B shown in FIG. 17B, and the decurl effect depending on the curvature of the warpage generated in the paper is stronger in the waiting position B than in the waiting position A. That is, when the curvature of the warpage generated in the opposite direction to the warpage generated in the paper is small, the decurl defect is strong, and as the curvature of the warpage generated in the opposite direction to the warpage generated in the paper is large, the decurl effect is weak. However, with a balance between the pressure by which the support member maintaining the warpage generated in the paper described later suppresses the paper and the decurl effect depending on the range in which the support member maintaining the warpage generated in the paper presses the paper in the width direction of the paper, the decurl effect of the waiting position A is consequentially stronger than that of the waiting position B.

Figure 18A:
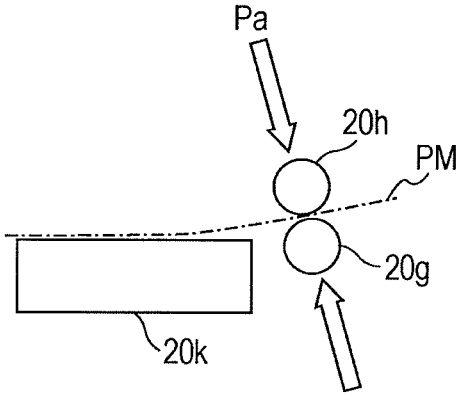
FIGS. 18A and 18B are diagrams that describe a relationship between the decurl effect and a pressure by which a support member maintaining the warpage generated in the paper suppresses the paper.
Figure 18B:
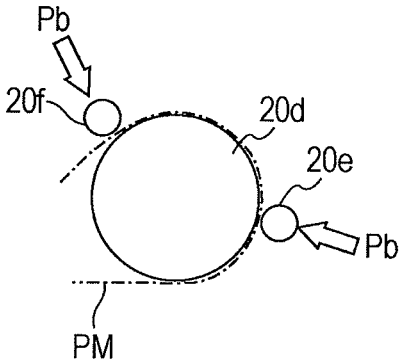

FIGS. 18A and 18B are diagrams that describe the relationship between the decurl effect and the pressure by which the support member maintaining the warpage generated in the paper suppresses the paper. The pressure Pa by which the paper feeding roller 20*g* and the paper feeding driven roller 20*h* pinching the printing paper PM in the waiting position A shown in FIG. 18A pinches the printing paper PM is stronger than the pressure Pb by which the middle roller 20*d* and the middle driven roller 20*e* or the middle roller 20*d* and the middle driven roller 20*f* pinching the printing paper PM in the waiting position B shown in FIG. 18B pinches the printing paper PM, and the decurl effect depending on the pressure, by which the support member maintaining the warpage generated in the paper suppresses the paper, is stronger in the waiting position A than in the waiting position B. That is, when the pressure, by which the support member maintaining the warpage generated in the paper suppresses the paper, is strong, the decurl effect is strong, and when the pressure, by which the support member maintaining the warpage generated in the paper suppresses the paper, is weak, the decurl effect is weak.

Figure 19A:
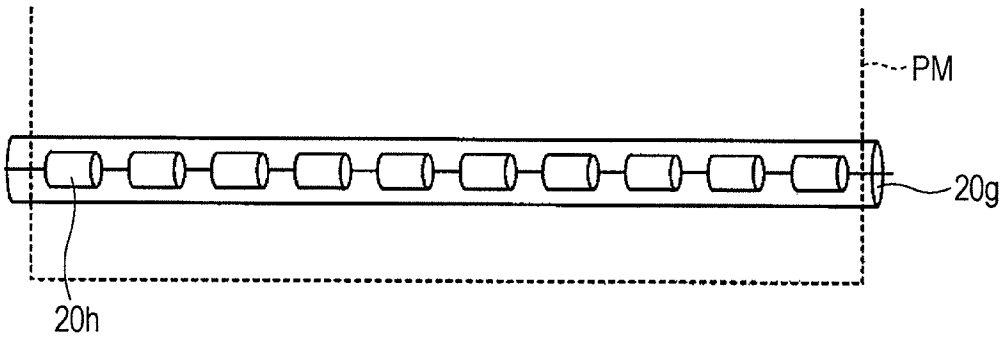
FIGS. 19A and 19B are diagrams that describe a relationship between the decurl effect and a range in which the support member maintaining the warpage generated in the paper is pressed in the width direction of the paper.
Figure 19B:
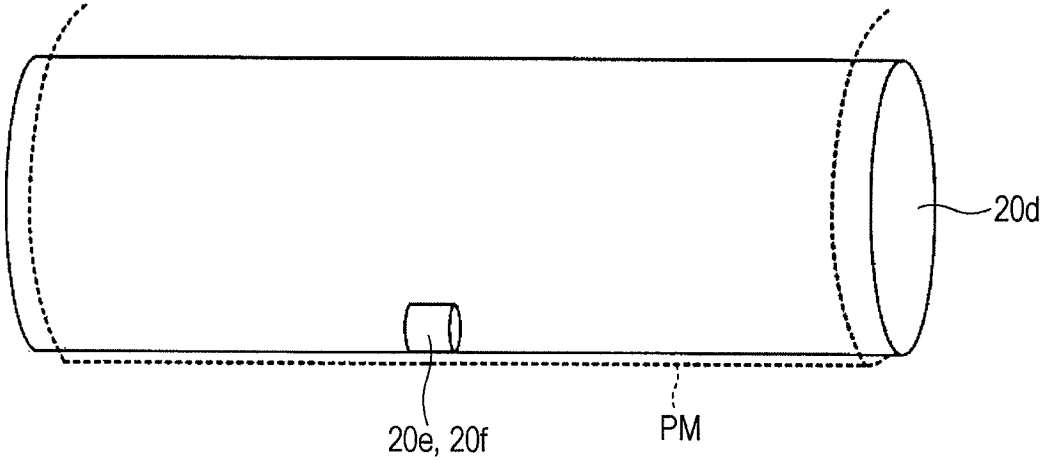

FIGS. 19A and 19B are diagrams that describe the relationship between the decurl effect and the pressure by which the support member maintaining the warpage generated in the paper presses the paper in the width direction of the paper. As shown in FIGS. 19A and 19B, the paper feeding roller 20*g* of the waiting position A and the middle roller 20*d* of the waiting position B have the width coming into contact with the entire range of the printing paper PM, but the paper feeding driven roller 20*h* of the waiting position A places the roller coming into contact with a site of the printing paper PM at a plurality of frames in the width direction of the paper to press the printing paper PM. Meanwhile, the middle driven roller 20*e* and the middle driven roller 20*f* according to the waiting position place the roller coming into contact with a site of the printing paper PM at one frame in a substantially middle position to press the printing paper PM. That is, the range, in which the support member maintaining the warpage generated in the paper presses the paper in the width direction of the paper, is wider in the waiting position A than in the waiting position B. As a consequence, the decurl effect depending on the range, in which the support member maintaining the warpage generated in the paper presses the paper in the width direction of the paper, is stronger in the waiting position A than in the waiting position B. That is, when the range, in which the support member maintaining the warpage generated in the paper presses the paper in the width direction of the paper, is wide, the decurl effect is strong, and when the range, in which the support member maintaining the warpage generated in the paper presses the paper in the width direction of the paper, is narrow, the decurl effect is weak.

Next, whether or not the front printing is completed is determined (S50). When the front printing is not completed (S50; No), the waiting is performed until the front printing is completed, and when the front printing is completed (S50; Yes), the printing paper PM is transported up to a position where the back printing is possible while performing the waiting in the waiting position decided in step S40 (S60). In the present embodiment, the transport corresponds to the reverse paper feeding of the paper.

The specification of the waiting position can be specified by, for example, the number of driving steps of the paper detection sensor 20*l* and the transport motor 34 that drives each roller shown in FIG. 9. As a more specific example, after the tip of the paper is detected by the paper detection unit, if the PWM driving of each roller is performed by a number of steps, the data showing that the waiting position is reached is prepared in advance. By performing the transport driving based on the data, the transport of the printing paper PM can be stopped in a desired position. Of course, a unit, which directly detects the transported position of the printing paper. PM, may be provided near the waiting position to detect that the paper reaches the waiting position, thereby stopping the transport. In addition, in the present embodiment, the waiting time from the waiting state to the resuming of transport is constant in each waiting position.

When transporting the printing paper PM up to the position where the back printing is possible, the transport control for back printing is performed (S70). That is, the back printing is performed by the recording head and the transport performed in connection with the transport control while performing the transport control for the back printing. In addition, for example, depending on the position relationship between the location where the back printing is performed and the waiting position, when the transport for the back printing is performed while performing the back printing, in some cases, another part, in which the back printing is not performed, may reach the waiting position. In such a case, it is possible to adopt a configuration so that the back printing is temporarily stopped at the point of time when the waiting target site comes to the waiting position during back printing, and the back printing is resumed after the waiting time elapses. When the back printing is completed, the printing paper PM is discharged to the stacker 12 and stacked thereon by the driving of the paper discharging roller 20*i* (S80).

As mentioned above, in the present embodiment, in the transport for reversing the front and the back of the paper so as to print the back of the printing paper PM after printing the front of the printing paper PM, the attachment amount of ink to the front of the printing paper PM is determined for each region of the front, on the path of the transport, in a predetermined position where the warpage of the opposite direction to the swelling curl of the printing medium generated by the attachment of ink to the front of the printing paper PM is generated in the site of the printing paper PM having the region in which the attachment of ink is determined to be equal to or greater than a predetermined value, and the transport of the printing medium waits for a predetermined time. Thus, it is possible to at least perform the suitable decurl depending on the attached ink, without adding the mechanism or the like to the printer 100.

3. MODIFIED EXAMPLES

3-1. Modified Example 1

In the embodiments mentioned above, the degree of the decurl effect properly used depending on the amount of ink injection was three steps (the waiting position A, the waiting position B, and does not wait); of course, the degree of the decurl effect suitably used depending on the amount of ink injection may be equal to or greater than 4 steps, and, for example, the degree of the decurl effect may be equal to or greater than 4 steps by providing the waiting positions in three or more locations.

3-2. Modified Example 2

In the embodiments and the modified example mentioned above, the plurality of decurl effects were realized by properly using the plurality of waiting positions, but the plurality of decurl effects may be realized by changing the waiting time. That is, even in the same waiting position, when the site having the region of the large amount of ink injection waits, the waiting time is increased, and when the site having the region of the small amount of ink injection waits, the waiting time is reduced. In this manner, by performing the waiting having the various waiting times, for example, even when the waiting position having the decurl effect is small, the decurl of the plurality of levels can be applied to the printing paper PM. Of course, by suitably combining the waiting position and the waiting time, the suitable decurl depending on the amount of ink injection can be performed.

3-3. Modified Example 3

In the embodiments and the modified examples mentioned above, the need for the waiting was determined for each region. However, in the case where there is a need for the waiting in regard to a plurality of regions, the waiting position and the waiting time may be independently set for each region, and the waiting time of another region may be reduced by considering the time when the waiting for the decurl is performed in another region.

3-4. Modified Example 4

As described in the embodiments and the modified examples mentioned above, when the amount of ink injection is large, the waiting for the strong decurl effect is performed, and when the amount of ink is small, the waiting for the small decurl effect is performed. That is, comparing a case where the printing mode is a speed preference to a case where the printing mode is an image quality preference, even in the case of printing the same image, the case of the speed preference adopts the waiting position of the weak decurl effect (or the waiting is not performed), and the case of the image preference adopts the waiting position of the strong decurl effect.

3-5. Modified Example 5

Figure 20:
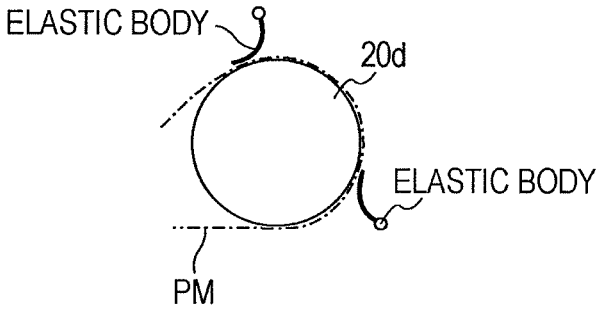
FIG. 20 is a diagram that shows an example of a case of using a roller and an elastic body.

In the embodiments and the modified examples mentioned above, when the printing paper PM is reversed, the roller and the driven roller are used as the member for maintaining the printing paper PM on the reverse paper feeding path. However, a biasing member such as a roller and an elastic body may be used. FIG. 20 shows an example of a case of the roller and the elastic body. FIG. 20 shows the case of applying the elastic body to the middle roller. As shown in FIG. 20, the middle roller 20*d* is formed of a member such as a rubber having high frictional force, and the printing paper PM wound around the middle roller 20*d* is transported along with the rotation of the middle roller 20*d*. At this time, the elastic body presses the printing paper PM against the roller surface of the middle roller 20*d*, thereby having a role of the biasing member that maintains the printing paper PM on the reverse paper feeding path.

3-6. Modified Example 6

In the embodiments and the modified examples mentioned above, the printer was described as an example which transports the printing paper PM by the roller, but the invention can, of course, be also applied to a printer that transports the printing paper PM by a belt driving. Furthermore, in the embodiments mentioned above, the middle roller 20*d* defines the reverse path of the printing paper PM, but the reverse path may be defined by a curved surface, and the printing paper PM can be moved on the reverse path by the roller along the curved surface. Furthermore, the number of the rollers can also be suitably changed.

3-7. Modified Example 7

Figure 21:
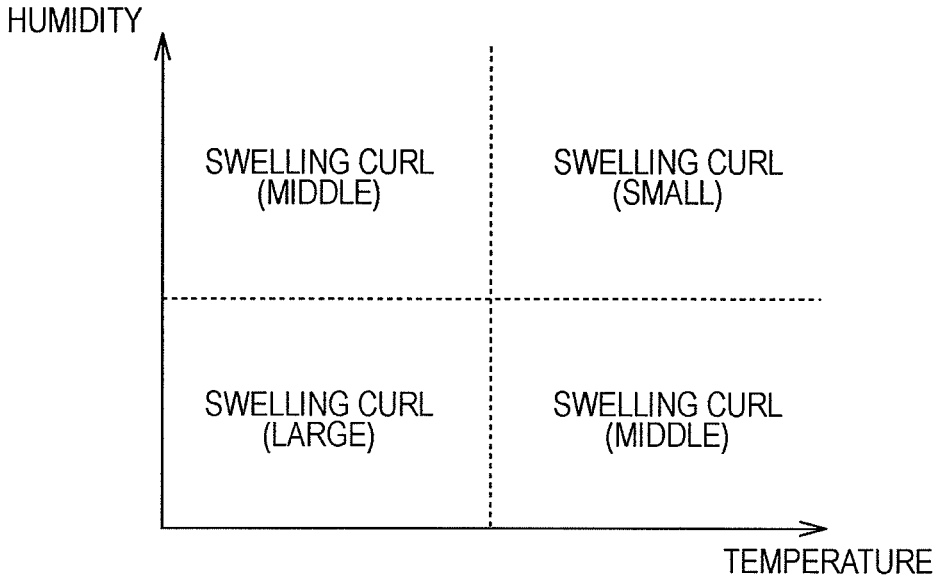
FIG. 21 is a graph showing how a degree of the swelling curl changes depending on a temperature and humidity.

In the embodiments and the modified examples mentioned above, the waiting position and the waiting time are adjusted so that the suitable decurl effect is applied to each region based on the amount of ink injection on the surface of the printing paper PM, but the waiting position and the waiting time may be decided by considering the printing environment such as the temperature and the humidity, in addition to the amount of ink injection. FIG. 21 is a graph that shows how the degree of the swelling curl changes depending on the temperature and the humidity. As shown in FIG. 21, there is a tendency that, as the temperature becomes higher, the warpage of the swelling curl becomes smaller, and as the humidity becomes higher, the warpage of the swelling curl becomes smaller. Thus, it is understood that, as the temperature becomes higher, the threshold value shown in FIG. 11 is lowered, and as the humidity becomes higher, the threshold value shown in FIG. 11 is lowered, whereby a more suitable decurl effect can be obtained. In addition, the printer 100 includes a temperature sensor and a humidity sensor, whereby the temperature and the humidity can be detected.

3-8. Modified Example 8

In the embodiments and the modified examples mentioned above, the presence and the absence of the waiting position and the waiting were decided based on the amount of ink injection to the surface. However, in a case where, the amount of ink injection to the front exceeds the threshold value of the duty and the printing pattern is not present in the back in some regions, the waiting may not be performed in the site having the region. In this manner, even in the region in which the swelling curl is generated by the front printing, when there is a small influence on the quality of the back printing performing on the back side of the region, the waiting is not performed, and the printing speed (a response speed) may take precedence.

3-9. Modified Example 9

In the embodiments and the modified examples mentioned above, the amount of ink injection is evaluated by a unit of the region; even in one region, there is a possibility that the portion having the large amount of ink injection may coexist with the portion having the small amount of ink injection. In such a case, depending on an area ratio of a printing portion and a non-printing portion, the amount of ink injection per a unit area and an average amount of ink injection in the entire region are suitably switched and are set to the amount of ink injection of each region. When the amount of ink injection is large in a narrow region (the amount of ink injection is locally large), the waiting position of the region is a position of the strong decurl effect, and when the amount of ink injection is large in a wide region (the amount of ink injection is large in the entire region), the waiting position of the region is set to the position of the weak decurl effect. More specifically, when the area of the printing portion is wider than the area of the non-printing portion in any region, it is determined that the ink injection is distributed in the entire region, and the threshold value is determined based on the average amount of ink injection of the region. Meanwhile, when the area of the non-printing portion is wider than the area of the printing portion in any region, it is determined that the ink injection is locally distributed, the threshold value is determined based on the maximum amount of ink injection per a unit area, and the waiting position is determined. In addition, in the case of suitably selecting the amount of ink injection depending on the area ratio of the non-printing portion and the printing portion, the threshold value of a case of determining the waiting position based on the average amount of ink injection of the region may be the threshold value that is different from a case of determining the waiting position based on the maximum amount of ink injection per a unit area. By such a configuration, the waiting position can be selected so as to suitably decurl the local curl.

In the embodiments mentioned above, the printing device was described as an example which discharges ink to perform the printing, but the printing device, to which the invention can be applied, may be an apparatus which discharges fluid other than ink, such as a liquid discharging device including a liquid discharging head ejecting (discharging) a minute amount of liquid droplet or the like. The liquid droplet includes examples such as a granular-shaped liquid, a tear-shaped liquid, liquid leaving traces in filiform shape or the like discharged from the liquid ejecting apparatus. Furthermore, a liquid may be a material capable of being ejected from the liquid discharging apparatus. For example, the material includes substances of a liquid state such as a liquid state body, sol, gel water, an inorganic solvent, an organic solvent, a solution, a liquid phase resin, and a flow regime like a liquid phase metal (a metallic melt). Furthermore, the liquid also includes substances of the liquid state, as well as material in which particles of a functional material formed of a solid body such as pigment and metallic particles are dissolved, dispersed or mixed in a solvent or the like. Furthermore, ink, a liquid crystal or the like are typical examples of liquid. The ink includes various liquid compositions such as a general water-based ink, an oil-based ink, a gel ink, and a hot-melt ink. The liquid discharging apparatus, for example, a liquid ejecting apparatus may be adopted which ejects liquid including a material such as an electrode material and a color material used in manufacturing a liquid crystal display, an EL (electroluminescence) display, a surface emitting display, and a color filter in the form of dispersion or dissolution. Furthermore, the liquid discharging apparatus includes a liquid ejecting apparatus which ejects an organic matter from a living body used in manufacturing a bio-chip, a liquid ejecting apparatus which is used as a precision pipette and ejects liquid becoming a sample, a printing device, a micro-dispenser, an apparatus which discharges lubricant oil in a pinpoint manner to a precision machine such as a watch and a camera, a liquid ejecting apparatus which discharges transparent resin liquid such as an ultraviolet curing resin onto a substrate so as to form a micro-hemispherical lens (an optical lens) or the like used in an optical communication element or the like, and an apparatus which discharges etching liquid such as acid or alkali so as to etch a substrate or the like.

In addition, the invention also includes a configuration in which the respective configurations disclosed in the embodiments and the modified examples mentioned above are mutually replaced or the combinations thereof are changed, a configuration in which the known techniques and the respective configurations disclosed in the embodiments and the modified examples mentioned above are mutually replaced or the combinations thereof are changed or the like, without being limited to the embodiments and the modified examples mentioned above.

What is claimed is:

1. A printing apparatus which performs a transport of a printing medium for performing an attachment of liquid to the other surface of the printing medium after performing the attachment of liquid to one surface of the printing medium, the one surface including a plurality of regions, the printing apparatus comprising:

a determination unit which determines an attachment amount of liquid for each region of the one surface; and a transport waiting unit which causes a predetermined site on the one surface of the printing medium to wait in a waiting position on a path of the transport for a predetermined time, wherein the predetermined site is a site that has a region in which the attachment amount of liquid is determined to be equal to or greater than a predetermined value by the determination unit, wherein a duration of the predetermined time is determined based on a location of the region of the predetermined site on the one surface of the printing medium, and the waiting position is a position where a warpage of an opposite direction to a warpage of the printing medium generated by the attachment of liquid to the one surface is generated in the printing medium;

wherein the waiting position is one of a plurality of waiting positions and wherein the waiting position is selected from the plurality of waiting positions in response to the location of the region of the predetermined site.

2. The printing apparatus according to claim 1, wherein the waiting position is a position where an end of the predetermined site in a direction, along which the printing medium is transported, is pinched by a pressing member, whereby the other end of the predetermined site in the direction, along which the printing medium is transported, is pressed against a predetermined table surface.

3. The printing apparatus according to claim 1, wherein the waiting position is a position where the entire predetermined site comes into contact with a reverse roller which reverses the front and the back of the printing medium.

4. The printing apparatus according to claim 1, wherein the predetermined site is a site which has a region in which the attachment of liquid to the one surface is performed in a state of pinching at least one end of the predetermined site by a biasing member, and the waiting position is a position where the entire predetermined site comes into contact with the reverse roller which reverses the front and the back of the printing medium.

5. The printing apparatus according to claim 1, wherein, in the waiting position, a biasing member, which maintains a state of generating a warpage of an opposite direction to the warpage of the printing medium generated by the attachment of liquid to the one surface in the printing medium, is configured to pinch the printing medium, and when there are a plurality of waiting positions, and one or more waiting positions are selected depending on curvatures of the warpage which is an opposite direction to the warpage of the printing medium generated by the attachment of liquid to the one surface and is generated in each waiting position, a range of the printing medium in a width direction in which the biasing member pinches the printing medium in each waiting position, and a biasing force by which the biasing member pinches the printing medium in each waiting position.

6. A printing method of performing a transport of a printing medium for performing an attachment of liquid to the other surface of the printing medium after performing the attachment of liquid to one surface of the printing medium, the one surface including a plurality of regions, the method comprising:

determining an attachment amount of liquid for each region of the one surface; and performing a waiting during transport which causes a predetermined site on the one surface of the printing medium to wait in a waiting position on a path of the transport for a predetermined time, wherein the predetermined site is a site that has a region in which the attachment amount of liquid is determined to be equal to or greater than a predetermined value in the determination, wherein a duration of the predetermined time is determined based on a location of the region of the predetermined site on the one surface of the printing medium, and the waiting position is a position where a warpage of an opposite direction to a warpage of the printing medium generated by the attachment of liquid to the one surface is generated in the printing medium;

wherein the waiting position is one of a plurality of waiting positions and wherein the waiting position is selected from the plurality of waiting positions in response to the location of the region of the predetermined site.

* * * * *